US011285502B2

(12) United States Patent
Thompson

(10) Patent No.: US 11,285,502 B2
(45) Date of Patent: Mar. 29, 2022

(54) CLEANING DEVICE

(71) Applicant: Mark Thompson, Duncanville, TX (US)

(72) Inventor: Mark Thompson, Duncanville, TX (US)

( * ) Notice: Subject to any disclaimer, the term of this patent is extended or adjusted under 35 U.S.C. 154(b) by 59 days.

(21) Appl. No.: 16/879,699

(22) Filed: May 20, 2020

(65) Prior Publication Data

US 2020/0368768 A1 Nov. 26, 2020

Related U.S. Application Data

(60) Provisional application No. 62/850,254, filed on May 20, 2019.

(51) Int. Cl.
*B05B 11/00* (2006.01)
*B08B 3/04* (2006.01)

(52) U.S. Cl.
CPC ..... *B05B 11/3011* (2013.01); *B05B 11/0054* (2013.01); *B05B 11/3053* (2013.01); *B08B 3/04* (2013.01)

(58) Field of Classification Search
CPC ..... B05B 11/3011; B05B 11/0054; B05B 11/3053; B05B 11/0038; B05B 15/62; B08B 3/04; B08B 3/028
USPC ..... 222/78; 134/18
See application file for complete search history.

(56) References Cited

U.S. PATENT DOCUMENTS 5,072,856 A * 12/1991 Kimble ..... F41B 9/0078 222/78
5,088,624 A * 2/1992 Hackett ..... B65D 83/68 222/78
5,429,301 A * 7/1995 Franks ..... B65D 83/384 222/145.1
5,678,730 A * 10/1997 Fabek ..... A45F 5/00 2/160
5,927,548 A * 7/1999 Villaveces ..... A45F 5/02 222/82
6,983,864 B1 * 1/2006 Cagle ..... B05B 11/0005 222/131
7,316,332 B2 * 1/2008 Powers ..... A45D 34/00 222/1
8,651,396 B2 * 2/2014 Spearman, Sr. ..... F41H 9/10 239/152
9,888,816 B1 * 2/2018 Shaukat ..... A47K 5/1204
10,042,984 B2 * 8/2018 Zaima ..... G16H 40/20

(Continued)

*Primary Examiner* — Vishal Pancholi
(74) *Attorney, Agent, or Firm* — Law Office of Jeff Williams PLLC; J. Oliver Williams

(57) ABSTRACT

A cleaning device includes a cartridge assembly, a hose/tubing, a nozzle, and an activator. The cartridge assembly includes at least one cartridge configured to hold a liquid solution. An attachment device is coupled to the cartridge assembly and is configured to secure the position of the cartridge assembly to a user's arm adjacent the hand. A pump is located within the cleaning device and is located between cartridge and the nozzle, such that pump regulates dispensing of the liquid solution. The nozzle is in communication with the pump and acts as a diffuser to adjust the stream of the liquid solution passed through the hose from pump. The activator is in communication with the pump such that operation of the activator selectively releases a volume of the liquid solution from the cartridge so as to pass through the nozzle. A control unit and interface are permitted.

20 Claims, 3 Drawing Sheets

(56) References Cited

U.S. PATENT DOCUMENTS

| | | | | |
|---|---|---|---|---|
| 2006/0289567 | A1* | 12/2006 | Shoham | A61B 90/80<br>222/175 |
| 2007/0194048 | A1* | 8/2007 | Teig | G08B 15/02<br>222/113 |
| 2007/0229288 | A1* | 10/2007 | Ogrin | G01F 11/006<br>340/573.1 |

* cited by examiner

CLEANING DEVICE

CROSS REFERENCE TO RELATED APPLICATIONS

This application claims the benefit of earlier filing date and right of priority to U.S. Provisional Application No. 62/850,254, filed 20 May 2019, the contents of which is incorporated by reference herein in its entirety.

BACKGROUND OF THE INVENTION

1. Field of the Invention

The present application relates to a cleaning device, and more particularly to a handheld cleaning device that mounts a cleaning solution to an arm of the user and permits for the selective disbursement of that solution.

2. Description of Related Art

Cleaning products of various types are in the market today. Their use is pretty consistent in that the cleaning product is typically held in a container prior to use. The cleaning product can be a concentrate which needs diluting or may be full strength. Upon use it is located in a bottle for application to a surface. A common form of bottle is a spray bottle. A user grabs the bottle with a hand and actuates a pivoting handle to spray a measure of cleaning product out a nozzle. An issue with these conventional bottles is that they are cumbersome and have to be carried on a cart, in a pocket, or other device as the user cleans. A disadvantage of these containers is that they are selectively grasped by a user to dispense a cleaning solution and then put down again. They consume the entire function of a hand. When grasped, the hand of the user is unable to do anything else. Therefore the user must pick up and put down the bottle repeatedly. Time is consumed with conventional bottles.

Although strides have been made with conventional bottles, shortcomings remain. It is desired that a cleaning device be provided that is conveniently transported by the user and allows full function of the hand while being carried. It is desired that an assembly be provided that is fully operable with a hand while allowing the same hand the freedom to grasp other objects.

BRIEF SUMMARY OF THE INVENTION

It is an object of the present application to provide a cleaning device that is configured to be coupled to a portion of a user's arm. The device is configured to selectively dispense a liquid cleaning solution with the hand that is adjacent the device. A user is simply activates the cleaning device to dispense the solution with a movement from part of the hand. The hand is free to operate and grasp objects. The hand of the user is not confined to hold the container during use.

It is a further object of the present application that the system is operable on either a mechanical or electro-mechanical basis. The cleaning device may include one or more activators (i.e. a user interface) or activation points to selectively control the dispensing of cleaning solution from a nozzle located over the back of the hand of the user. The activator will be adjacent the palm of the user. One or more sensors, processors, motors, and power supplies may be used to operate the cleaning system. Additionally, the user is able to select or vary the type of spray, volume of fluid released, or control even the duration of operation.

Another object of the present application is to have the cleaning device configured to operate with one or more cleaning cartridges each containing at least one cleaning solution. The user may engage the activator to selectively control which of the one or more cleaning solutions available is dispensed. The cartridges are interchangeable to allow fast efficient swapping of cleaning solutions.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
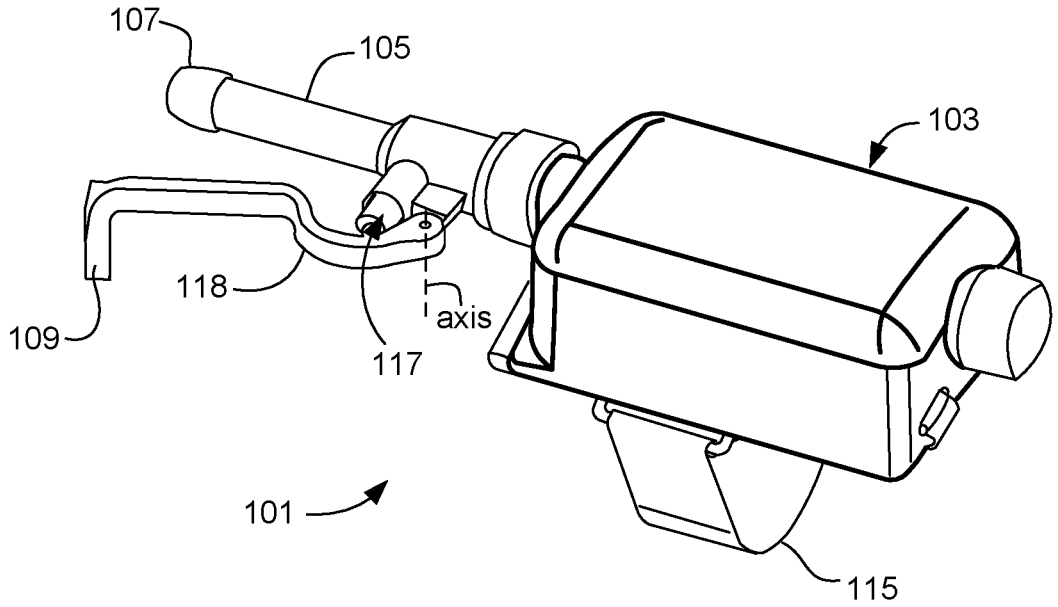
FIG. 1 is a perspective view of a cleaning device according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. In particular, the cleaning device of the present application provides a hands-free method of selectively releasing a cleaning solution onto a surface by providing for a method of attachment of the cleaning device to a user. The user can engage an activator that selectively dispenses a volume of liquid solution. The cleaning device may be electronically controlled or mechanically controlled. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

The cleaning device of the present application is configured to releasably attach to a user's arm and provide a nozzle in line with the arm and hand for the dispensing of a liquid product, such as a cleaning liquid solution. The device is configured to activate a spray of the liquid solution from a nozzle through engagement with an activator. The activator is located in the palm area of the hand. The liquid product is held within a cartridge and can be swapped out as needed.

Figure 2:
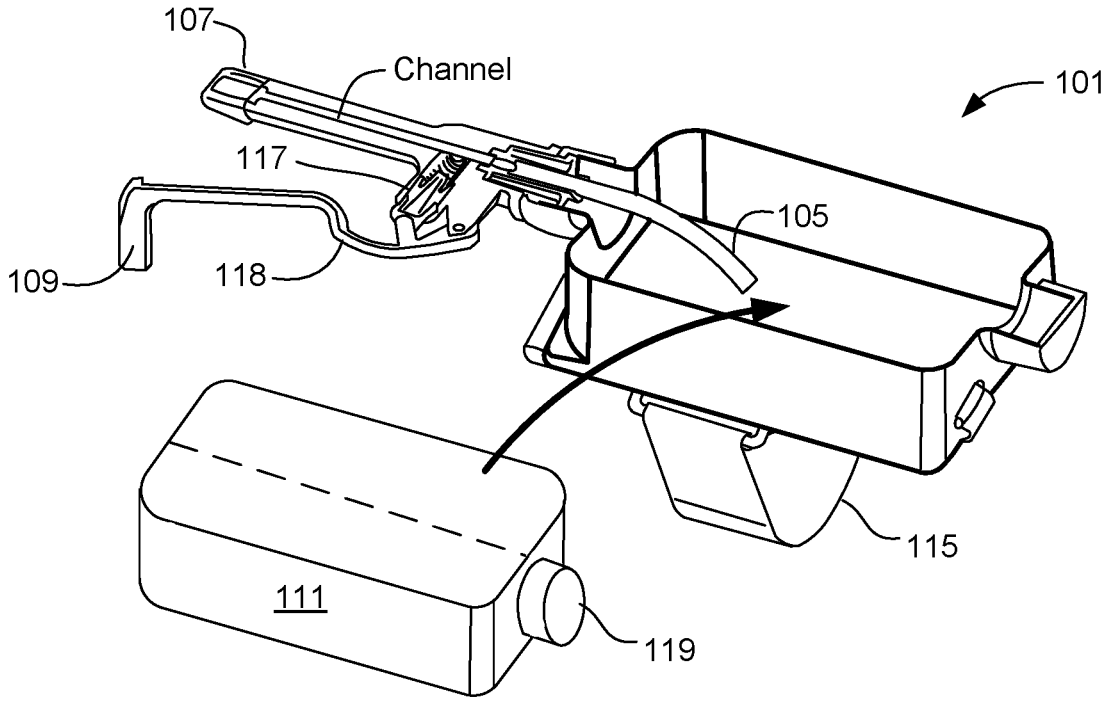
FIG. 2 is a section view of the cleaning device of FIG. 1.

Referring now to FIGS. 1 and 2 in the drawings, a perspective view of a cleaning device 101 is illustrated. FIG. 1 shows cleaning device as a whole while FIG. 2 shows a section view of cleaning device 101 with a cartridge removed. As noted above cleaning device 101 is configured to selectively dispense a volume of liquid solution through a nozzle. Cleaning device 101 is configured to be secured to an arm of the user to avoid the need to pick up and drop off miscellaneous bottles of cleaner. Additionally, cleaning device 101 allows the user to always keep the hand free such that activation of the cleaning device 101 can be done with a singular movement from one portion of the hand, such as a finger.

Cleaning device 101 includes a cartridge assembly 103, a hose/tubing 105, a nozzle 107, and an activator 109. cartridge assembly 103 includes at least one cartridge 111 configured to hold a liquid solution. An attachment device 115 is coupled to the cartridge assembly 103 and is configured to secure the position of the cartridge assembly 103 to a user's arm adjacent the hand. A pump 117 is located within the cleaning device 101 and is located between cartridge 111 and nozzle 107, such that pump 117 regulates dispensing of the liquid solution. Nozzle 107 is in communication with the pump 117 and acts as a diffuser to adjust the stream of the liquid solution passed through the hose 105 from pump 117. Activator 109 is in communication with the pump 117 such that operation of the activator selectively releases a volume of the liquid solution from the cartridge 111 so as to pass through the nozzle 107.

The cartridge assembly 103 is configured to hold within its body cartridge 111 which contains a quantity of a liquid solution. One or more cartridges may be held therein. A user is able to remove cartridge 111 and interchange it with another cartridge. The liquid solution may be a cleaning solution or just water for example. It is understood that a single cartridge can hold a single liquid product. Other embodiments of the cartridge may include multiple housings for an assortment of different liquid cleaning products. In such a case, the cartridge or the cartridge assembly may include a dial 119 or switch to allow manual switching between which liquid product is engaged with hose 105.

The cartridge assembly 103 includes an attachment device 115 for attachment to the arm of the user. The attachment device 115 locates the cartridge assembly 103 and secures it in relation to the arm of the user. The attachment device 115 wraps around a portion of the arm and may use a compressive force to hold it to the arm. The attachment device 115 may stop short of wrapping fully around the arm. In other embodiments, the body may wrap fully around the arm as seen with the strap configuration in FIGS. 1 and 2. The attachment device 115 may include both rigid and flexible parts, such as straps to accomplish attachment to the arm.

Hose 105 is in fluid communication with the liquid solution of the one or more cartridges 111. Hose 105 may pass internally inside cartridge 111 for example. In another method, a volume of liquid solution may be withdrawn automatically from cartridge 111 which is then communicated to hose 105. More than one hose 105 is possible wherein each hose may interact with a different cartridge or with a different liquid solution held within a single cartridge.

The hose 105 is flexible and is configured to extend past pump 117 and down the arm such that it is adjacent the back of the user's hand. The flexibility of the hose is important as the hand is flexible at the wrist. As seen in FIG. 2, hose 105 may become more of a channel within a larger body. Such body may be considered an extension of hose 105.

The nozzle 107 is located at the end of the hose 105 and is configured to regulate the spray of the liquid solution as it leaves hose 105. Rotation of nozzle 107 can adjust the type of spray from a mist to a stream as desired. The nozzle and the liquid solution are in fluid communication with each other.

Pump 117 is located within the stream of liquid solution from cartridge 111 to nozzle 107. Pump 117 is depicted as a mechanical pump that is configured to include a spring body and piston, that when activated, pressurizes a selected volume of liquid solution toward nozzle 107. Multiple types of pumps are possible. Any mechanical or electrical pump may be used. In the Figures, activator 109 is in communication with pump 117 and acts as a lever to cycle pump 117.

Activator 109 is located adjacent the palm of the user's hand. A connector 118 wraps around a side of the hand, ideally by the thumb of the hand and locates the activator 109 near the palm. The connector 118 may be flexible or have a hardened body to help stabilize the activator in the palm and prevent its undesired movement. The connector 118 may have a spring tension between it and the lower surface of the hose so as to clamp around the hand. Although conceivable and potentially usable, it is desired that adhesives are not used or needed. Other straps of connection devices may be used to stabilize the activator in the palm. It is desired that the activator maintains its position in the palm without use of the fingers. This allows the fingers to be used to grasp other items and perform work. This is one key feature beyond conventional bottles.

Activator 109 may be located near any finger or thumb of the hand. For example, the thumb may pivot activator 109 about an axis at the pump 117. Other methods of activation are possible and cleaning device 101 is not herein limited to a thumb operated or mechanically activated configuration.

Figure 3:
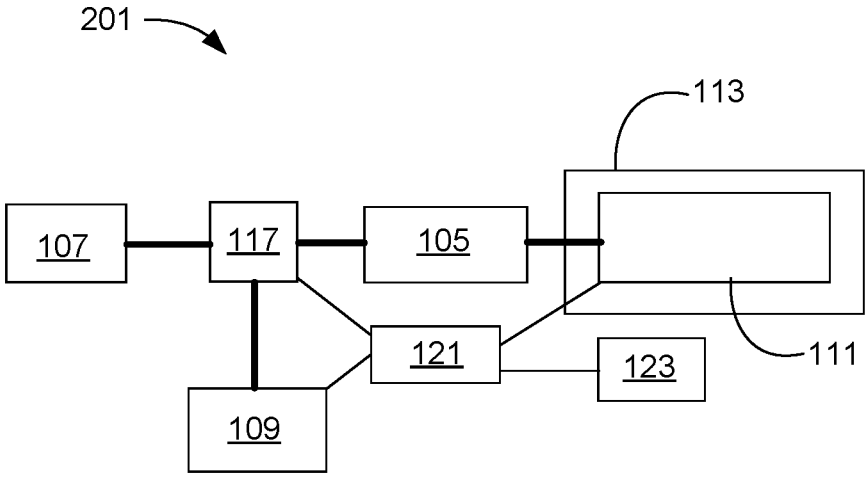
FIG. 3 is a schematic of the cleaning device of FIG. 1 having a control unit.

Referring now also to FIG. 3 in the drawings, a schematic of an electrically controlled cleaning device is illustrated. It is understood that the activator 109 may be any electrical and/or mechanical device that is capable of instigating the release of liquid product from the nozzle. The cleaning device 101 is shown as a strictly mechanical configuration in FIGS. 1 and 2, but it is understood that one or more electronics may be applied therein to enhance usability, form and fit, and function as needed. Cleaning device 201 is similar in form and function to that of cleaning device 101 except that device 201 is electronically controlled in at least one aspect.

In an electronic configuration, pump 117 and/or activator 109 may be regulated by a control unit 121. Control unit 121 may include one or more processors, memory storage and be able to communicate through one or more input/output interfaces 123. It includes an internal power supply and is able to be recharged through conventional means. Data may be stored, processed and transmitted through control unit 121 to carry out a desired purpose. A user interface 123 may be included to permit a user operational control of device 201. Through interface 123, a user may adjust settings related to the liquid solution and the pump such as duration the pump runs, the volume of liquid solution released, which liquid solution is dispensed, the mixing of different liquid solutions, and so forth. With an electronic configuration, activator 109 may be any electronically controlled device such as a touch pad. It may provide haptic feedback to the user. A user may be able to adjust settings in unit 121 by manipulation of activator 109.

Figure 4:
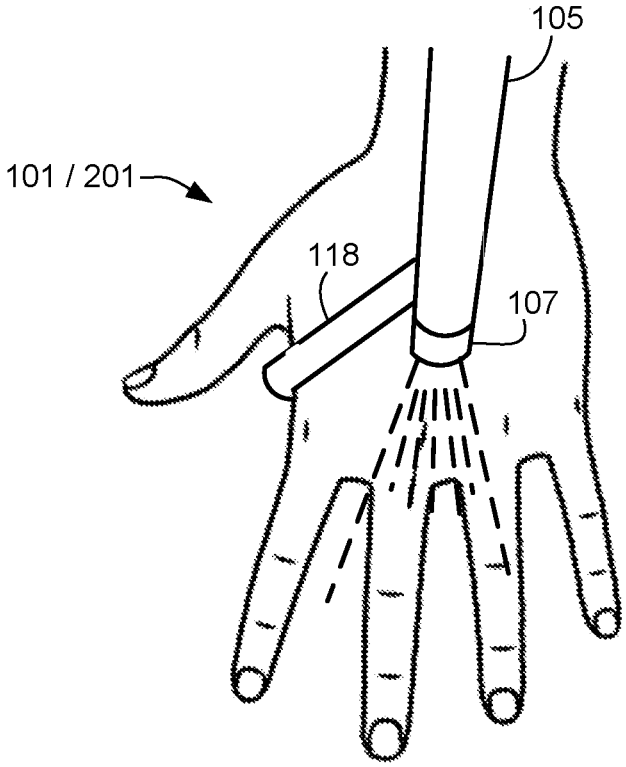
FIG. 4 is an upper view of an exemplary embodiment of the cleaning device of FIGS. 1 and 3 located on the user's hand.
Figure 5:
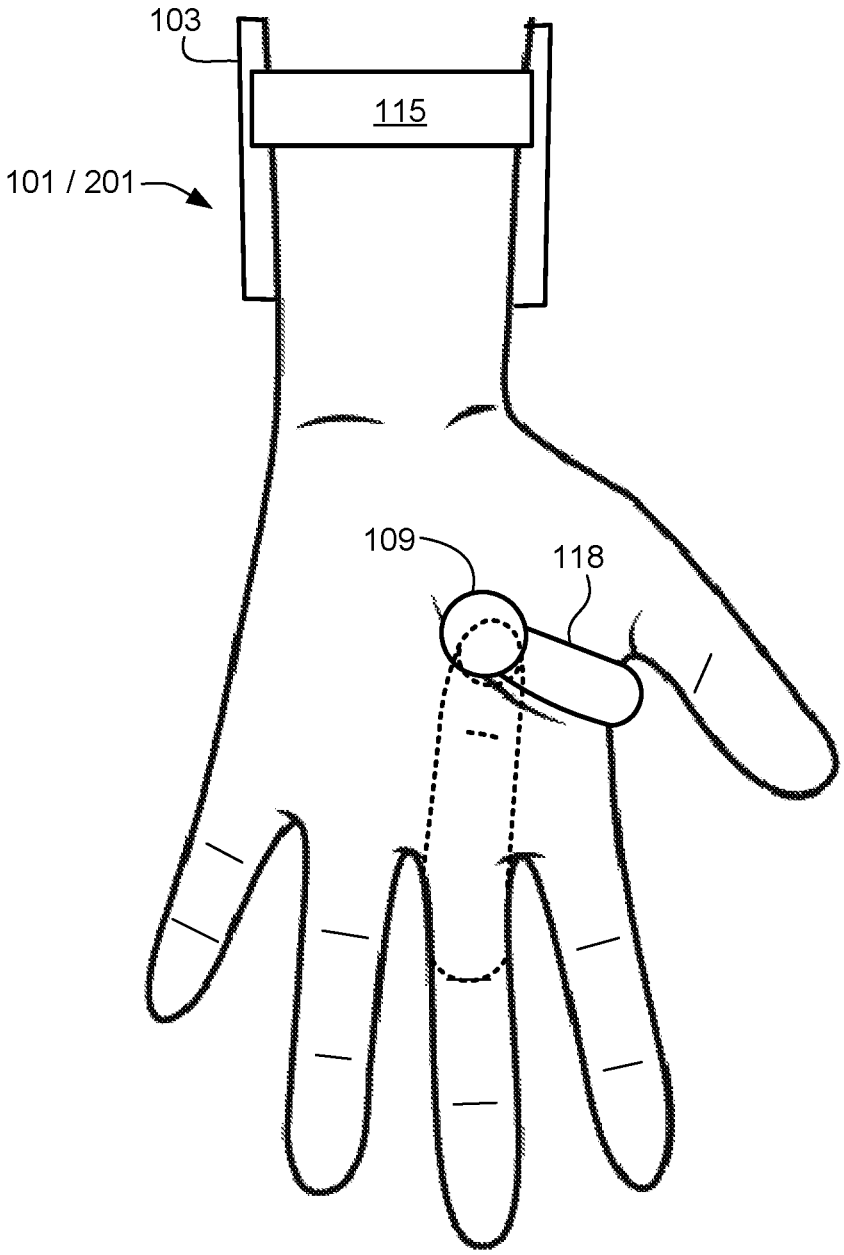
FIG. 5 is a lower view of the exemplary embodiment of the cleaning device of FIG. 4.

Referring now also to FIGS. 4 and 5 in the drawings, exemplary views of cleaning device 101/201 are provided. In FIG. 4, a spray of liquid solution is shown being released through nozzle 107. In FIG. 5 a lower view of the user's hand is shown with device 101/201 coupled about the arm adjacent the wrist. Connector 118 extends around the hand and locates activator 109 near the palm. In a mechanical configuration, activator may be operated by compression or some mechanical force exerted by one of the fingers/thumb. In an electronically controlled configuration, activator 109 may only need a touch or series of touches to operate pump 117. The middle finger is shown optionally folded into contact with activator 109.

It is understood that the Figures and description illustrate at least one type of embodiment for the operation of the cleaning device. Many embodiments are possible and the Figures are not intended to be limited to this particular manner of bringing it about.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A cleaning device, comprising:

a cartridge assembly including at least one cartridge, the cartridge holding a liquid solution;

an attachment device coupled to the cartridge assembly, the attachment device configured to secure the position of the cartridge assembly to a user's arm;

a pump in the cartridge assembly and in fluid communication with the liquid solution;

a hose extending out from the cartridge assembly;

an external nozzle in communication with the pump and coupled to the hose; and an activator coupled to the hose in communication with the pump, the activator configured to selectively release a volume of the liquid solution from the cartridge so as to pass through the nozzle.

2. The cleaning device of claim 1, wherein the cartridge is removable from the cartridge assembly.

3. The cleaning device of claim 1, wherein the cartridge is configured to include a second liquid solution.

4. The cleaning device of claim 3, wherein a single liquid solution is dispensed from the nozzle.

5. The cleaning device of claim 3, wherein a combination of liquid solutions from the liquid solution and the second liquid solution is dispensed from the nozzle simultaneously.

6. The cleaning device of claim 1, wherein the activator is mechanically operated.

7. The cleaning device of claim 1, wherein the activator is electro-mechanically operated.

8. The cleaning device of claim 1, further comprising:

a control unit in communication with the activator and the pump, the control unit configured to electronically regulate the dispensing of the liquid solution.

9. The cleaning device of claim 8, wherein the control unit includes a user interface operable through touch.

10. The cleaning device of claim 8, wherein the control unit includes a power supply.

11. The cleaning device of claim 8, wherein the control unit is rechargeable.

12. A cleaning device, comprising:

a cartridge assembly including at least one cartridge, the cartridge holding a liquid solution;

an attachment device coupled to the cartridge assembly, the attachment device configured to secure the position of the cartridge assembly to a user;

a pump in the cartridge assembly and in fluid communication with the liquid solution;

a hose protruding out from the cartridge assembly;

an external nozzle in communication with the pump and coupled to an end of the hose;

an activator coupled to the hose in communication with the pump, the activator located between the nozzle and the cartridge assembly, the activator configured to selectively release a volume of the liquid solution from the cartridge so as to pass through the nozzle; and a control unit in communication with the activator, the control unit configured to electronically regulate the dispensing of the liquid solution as the activator is manipulated.

13. The cleaning device of claim 12, wherein the cartridge is removable from the cartridge assembly.

14. The cleaning device of claim 12, wherein the cartridge is configured to include a second liquid solution.

15. The cleaning device of claim 14, wherein a single liquid solution is dispensed from the nozzle.

16. The cleaning device of claim 14, wherein a combination of liquid solutions from the liquid solution and the second liquid solution is dispensed from the nozzle simultaneously.

17. The cleaning device of claim 12, wherein the control unit regulates the duration and volume of liquid solution released.

18. The cleaning device of claim 12, wherein control unit further includes a second cartridge assembly containing a second liquid solution;

wherein the control unit switches between the liquid solution and the second liquid solution.

19. A method of dispensing a liquid cleaning solution, comprising:

obtaining a cleaning device according to claim 1;

securing the cleaning device to an arm such that the cleaning device contacts a back of a hand;

inserting the cartridge into the cartridge assembly;

locating the activator in a palm of the hand, the arm carrying the cartridge assembly to free the user's hand; and engaging the activator to release the liquid solution from the nozzle;

wherein the hand is unencumbered with carrying or holding the cleaning device, the activator is unobstructed to grasp remote objects during engagement with the activator.

20. The method of claim 19, wherein the activator includes a control unit configured to regulate the release of the liquid solution through electronic means.

* * * * *